US007866589B2

(12) United States Patent
Fink et al.

(10) Patent No.: US 7,866,589 B2
(45) Date of Patent: Jan. 11, 2011

(54) WIND-ON DEVICE FOR WORKSTATIONS OF TWO-FOR-ONE TWISTERS AND PLY TWISTERS

(75) Inventors: Heinz Fink, Krefeld (DE); Georg Heinen, Tönisvorst (DE); Wolfgang Leupers, Mönchengladbach (DE); Joachim Beckers, Mönchengladbach (DE)

(73) Assignee: Oerlikon Textile GmbH & Co. KG, Monchengladbach (DE)

( * ) Notice: Subject to any disclaimer, the term of this patent is extended or adjusted under 35 U.S.C. 154(b) by 306 days.

(21) Appl. No.: 12/083,738

(22) PCT Filed: Aug. 22, 2006

(86) PCT No.: PCT/EP2006/008245

§ 371 (c)(1),
(2), (4) Date: Apr. 18, 2008

(87) PCT Pub. No.: WO2007/045296

PCT Pub. Date: Apr. 26, 2007

(65) Prior Publication Data

US 2009/0230230 A1 Sep. 17, 2009

(30) Foreign Application Priority Data

Oct. 19, 2005 (DE) ..... 10 2005 050 074

(51) Int. Cl.
*B65H 54/02* (2006.01)
*B65H 54/42* (2006.01)
*B65H 59/18* (2006.01)

(52) U.S. Cl. ..... 242/472.8; 242/486.1; 57/58.7; 57/58.83

(58) Field of Classification Search ..... 242/472.8, 242/472.9, 473, 473.1, 484.9, 485, 485.2, 242/485.3, 485.9, 486, 486.1; 57/58.7, 58.83
See application file for complete search history.

(56) References Cited

U.S. PATENT DOCUMENTS

| | | | | |
|---|---|---|---|---|
| 2,677,506 | A * | 5/1954 | Moos | 242/485.9 |
| 3,409,237 | A * | 11/1968 | Pospisil et al. | 242/485.9 |
| 4,497,451 | A * | 2/1985 | Guggemos et al. | 242/485.3 |
| 4,798,347 | A * | 1/1989 | Schippers et al. | 242/485.9 |

(Continued)

FOREIGN PATENT DOCUMENTS

| | | |
|---|---|---|
| DE | 1 900 929 | 9/1964 |

(Continued)

*Primary Examiner*—William E Dondero
(74) *Attorney, Agent, or Firm*—K&L Gates LLP

(57) ABSTRACT

Wind-on device for workstations of two-for-one twisters and ply twisters with a take-up bobbin, a drive shaft extending in the longitudinal direction of the machine, a friction roller which is driven by the drive shaft and causes the take-up bobbin to make a rotational movement, and a driven advance roller positioned upstream of the friction roller in the yarn run. According to the invention, in addition to the friction roller (14, 15), the advance roller (8, 9) is also driven by the drive shaft (27, 28) and in that the advance roller (8, 9) is mounted on a support element (23, 24) and can be pivoted together with the support element (23, 24) about a pivot axle selectively into an operating position or into a higher situated service position.

8 Claims, 1 Drawing Sheet

U.S. PATENT DOCUMENTS

2002/0033012 A1 3/2002 Kamp ..... 57/58.83

FOREIGN PATENT DOCUMENTS

DE 73 22 625 8/1975
DE 88 15 754 5/1990
DE 42 17 360 A1 12/1993
DE 100 45 909 A1 4/2002

* cited by examiner

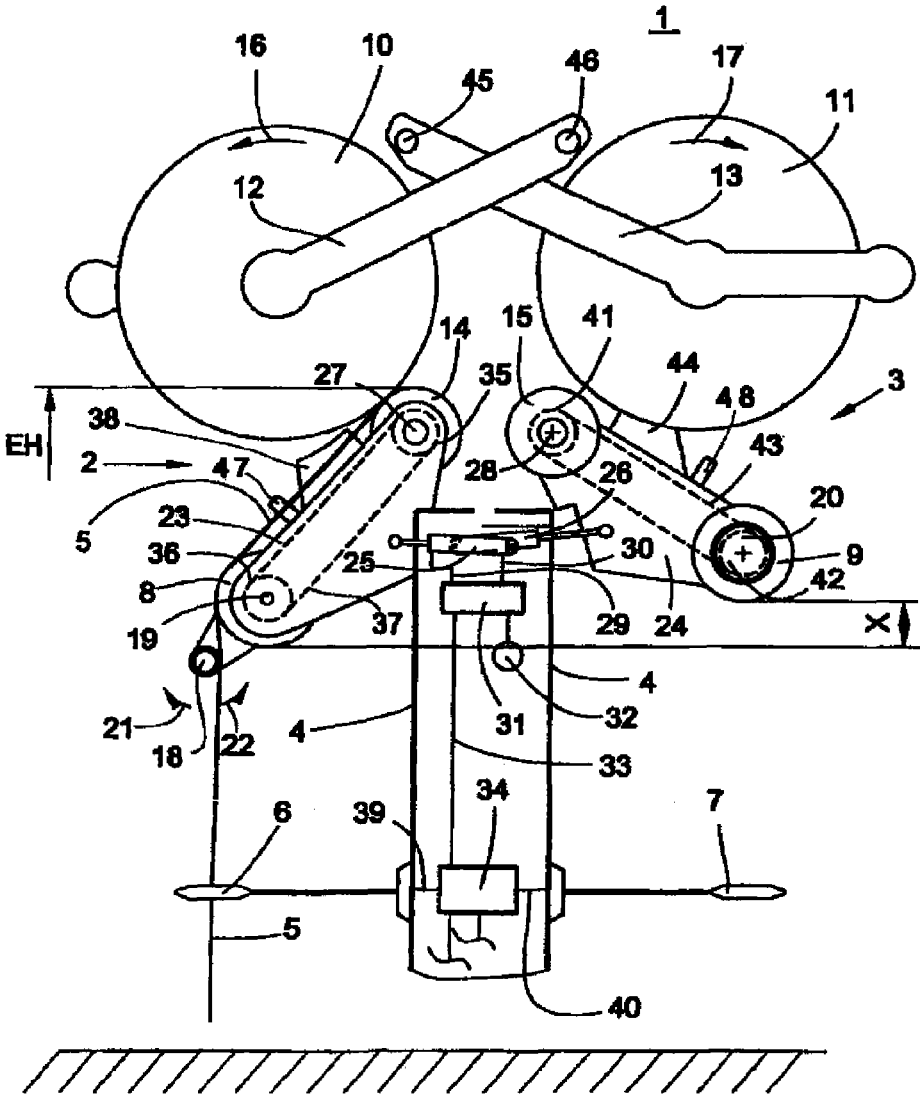
1
16
10
45
46
17
11
12
13
14
15
41
27
35
44
48
3
38
EH
2
47
43
28
26
20
5
23
36
25
30
9
8
42
19
37
29
24
X
4
21
18
22
4
31
32
33
34
6
39
7
5
40

WIND-ON DEVICE FOR WORKSTATIONS OF TWO-FOR-ONE TWISTERS AND PLY TWISTERS

CROSS-REFERENCES TO RELATED APPLICATIONS

This application claims the benefit of German patent application 10 2005 050 074.9, filed Oct. 19, 2005, herein incorporated by reference.

BACKGROUND OF THE INVENTION

The invention relates to a wind-on device for workstations of two-for-one twisters and ply twisters, and more particularly relates to wind-on device for twisters having a take-up bobbin, a drive shaft extending in the longitudinal direction of the machine, a friction roller which is driven by the drive shaft and causes the take-up bobbin to make a rotational movement, and a driven advance roller positioned upstream of the friction roller in the yarn run.

Textile machines configured as two-for-one twisters and ply twisters generally have a large number of workstations, each comprising a twisting spindle region or ply twisting spindle region and a wind-on region. The workstations are arranged next to one another in the longitudinal direction of the machine. The yarn is processed in the twisting spindle region or ply twisting spindle region. The necessary twist is imparted to the yarns there. The twisted yarn is then wound to form a cross-wound bobbin in the wind-on region.

A two-for-one twister is known from German Patent Publication DE 88 157 54 U1, in which identically constructed workstations are in each case arranged in the conventional manner on opposing outsides of the machine to achieve a high degree of utilisation of space of the textile machine. The finished take-up bobbins are transferred by means of a transfer device from the creel to a conveyor belt running in the centre of the machine. The creel carrying the cross-wound bobbin is connected to a support arm. The pivot axle of the support arm is arranged in the region below the conveyor belt. This is to achieve a low overall height of the machine in order to be able to arrange the supply device for feed bobbins above the twister at a comparatively low and still comfortably reachable height. Free access to yarn-guiding parts is to be achieved by the arrangement of the support arm and creel in the region between the winding-on cylinder and the vertical longitudinal centre plane of the machine.

German Patent Publication DE 42 17 360 C2 describes a twister in which a plurality of twisting spindles are arranged in the conventional manner on a spindle rail. The twisting spindles configured as ply twisting spindles have a bobbin pot surrounding a first yarn bobbin. A second yarn bobbin is arranged outside the bobbin pot. The twisted yarn formed is supplied to the wind-on device via a deflection roller.

The wind-on region of these textile machines as usual consists in each case of an advance roller associated with the workstation for the purpose of building up tension of the yarn, a traversing yarn displacement device for forming the cross-wound bobbin, a winding roller for driving the tube or the bobbin body and a creel, which holds the tube or the cross-wound bobbin.

Both the advance roller and also the winding roller of the known wind-on devices are driven, in each case, by means of continuous shafts. The shafts on the two sides of the machine in the longitudinal direction of the machine pass through the entire textile machine. Each shaft is driven by a drive device at the head end of the machine. The continuous shafts are, as shown, for example, for the shaft of the advance rollers in German Patent Publication DE 100 459 09 A1, frequently equipped with covers. The covers are to be used to prevent accidents and to reduce soiling of the shaft bearings. The upper installation space of the two-for-one or ply twister facing the operator is filled by continuous shafts or covers. This makes free access to the wind-on device more difficult.

To fit the textile machine with the necessary twisting or ply twisting material in the form of working spindles, adequate free space has to be available between the spindle and wind-on region, corresponding to the bobbin size, to make ergonomic servicing possible. The provision of this installation space substantially influences the working height of the textile machine. The working height is taken to mean here the upper edge of the winding roller driving the cross-wound bobbin by friction.

In order to maintain an ergonomic servicing height of 1,370 mm, for example with feeds of various sizes, the spindle rail carrying the twisting or ply twisting spindle is lowered. This allows ergonomic servicing. A change in the spindle rail position is also carried out, for example, when more installation space is required, because two feed bobbins are used to save on the doubling process.

Different arrangements of this type of the spindle rail have the drawback, however, that various designs or cross-sections of the textile machine are produced and therefore a diversity of types is brought about. This leads to increased costs.

SUMMARY OF THE INVENTION

The object of the invention is to provide a textile machine of the type mentioned at the outset which is ergonomically configured and distinguished by a uniform and cost-saving structure.

This object is achieved by providing a wind-on device for workstations of two-for-one twisters and ply twisters equipped with a take-up bobbin, a drive shaft extending in the longitudinal direction of the machine, a friction roller which is driven by the drive shaft and causes the take-up bobbin to make a rotational movement, and a driven advance roller positioned upstream of the friction roller in the yarn run. According to the invention, in addition to the friction roller, the advance roller is also driven by the drive shaft and the advance roller is mounted on a support element and can be pivoted together with the support element about a pivot axle selectively into an operating position or into a higher situated service position.

Advantageous further configurations, features, advantages, and embodiments of the wind-on device of the present invention are described more fully hereinafter.

If the advance roller is in each case mounted on a support element and can be pivoted together with the support element about a pivot axle selectively into an operating position and a service position, the free servicing space for the spindle can be substantially increased by the pivoting of the support element such that a uniform overall size of the textile machine can be used for feeds of different sizes. The free space being produced by pivoting up the support element allows unhindered servicing in the service position even if the spindle rail is not lowered as in known machine designs. The servicing height of the textile machine does not need to exceed a value of 1,300 mm to provide adequate free space for servicing. The current demands made with regard to ergonomics are therefore fulfilled.

A continuous separate shaft for the advance roller together with associated shaft bearings and drive are dispensed with. In the wind-on device according to the invention, the cover extending along the continuous drive shaft of the advance rollers in conventional wind-on devices, which is used for the protection of the shaft bearings and is necessary to prevent accidents on the continuous, continuously rotating drive shaft, is also superfluous. With the omission of the continuous shaft for the advance rollers, an additional free space is produced in the region of the wind-on device to the side of the advance rollers, which allows better accessibility of the creel and therefore ergonomically improved serviceability.

A wind-on device, the friction roller of which is fixed on the drive shaft and the advance roller of which is driven by means of a transmission element by the drive shaft and wherein the drive shaft forms the pivot axle of the support element is a particularly simple and economical design which also allows a compact space-saving configuration.

A transmission element configured as a round belt is connected with low expenditure and allows reliable operation. The drive can act by means of round belts as a slip coupling owing to its surface character in conjunction with a preselected feed tension. This increases the security of the advance roller against accidents.

The support element advantageously comprises an attachment directed toward the take-up bobbin, by means of which the take-up bobbin is raised from the drive roller in the service position. During the pivoting movement of the support element from the operating position into the service position, the attachment of the support element rests on the surface of the wind-on roller and entrains the latter in the further course of the pivoting movement. The wind-on roller thus lifts up from the friction roller. The wind-on roller becomes automatically driverless, and the rotation of the wind-on roller is stopped. Separate coupling devices for separating the take-up bobbin from the continuously rotating drive shaft are not necessary either and nor is the use of pivot drives for pivoting up the creel holding the cross-wound bobbin.

The support element can be pivoted easily and quickly by means of a lifting cylinder.

The pivoting movement of the support element is possible in a particularly rapid, reliable and disruption-free manner with a lifting cylinder configured as a pneumatic cylinder. In this case, the compressed air supply present in the textile machine can be used.

The pivoting process into the service position can be triggered automatically with a stop motion, which is arranged in the yarn run upstream from the advance roller and which generates a signal to pivot up the support element if a yarn is no longer detected. The maintenance work can be started without delay and without hindrance.

The wind-on device according to the invention does not only allow uniformity of the configurations of two-for-one twisters and ply twisters with different feeds in the spindle region. Activities such as yarn piecing, clearing and removing wind laps in the region of the advance roller are considerably simplified. Improved accessibility of the yarn deflection roller and simplified exchange and replacement or changing of the advance disc are also made possible.

Owing to the large free space created according to the invention by the support element after adopting the service position, during handling of the spinning pot, it is easier to avoid the spinning pot striking against parts of the textile machine.

The servicing of the workstation is safer and the prevention of accidents at the double twisters and ply twisters is improved.

BRIEF DESCRIPTION OF THE DRAWINGS

Further details of the invention can be inferred from the embodiment of the FIGURE.

The single FIGURE shows a wind-on region of a textile machine with two opposing wind-on devices, wherein the textile machine may be both a two-for-one twister or a ply twister.

DETAILED DESCRIPTION OF THE PREFERRED EMBODIMENT

The wind-on region 1 of the textile machine shown in the FIGURE has two wind-on devices 2, 3 of two opposing workstations. The wind-on devices of the textile machine are similarly constructed. The textile machine may be configured as a two-for-one twister or as a ply twister. The wind-on devices are supported on a common frame 4 of the textile machine. The yarn 5 drawn from the spindle region, not shown for reasons of simplification, is guided, in the respective wind-on device 2, 3 firstly through a stop motion 6, 7 and then via a driven advance roller 8, 9, through a traversing yarn displacement device 47, 48 until it is finally wound onto the take-up bobbin configured as a cross-wound bobbin 10, 11. The cross-wound bobbin 10, 11 is held by a creel 12, 13 and made to rotate in the direction of the arrow 16, 16 by a friction roller 14, 15. The advance roller 8, 9 reduces the pretensioning of the yarn 5 prior to winding on. Associated with the advance roller 8, 9 is a deflection roller 18, which can be pivoted about the same axis 19, 20 of rotation, about which the advance roller 8, 9 rotates, in the direction of the arrows 21, 22. The looping angle of the yarn around the advance roller 8, 9 can be increased or reduced with the deflection roller 18. Accordingly, a larger reduction in the yarn tension is brought about with a larger looping angle and a smaller reduction in the yarn tension is brought about with a smaller looping angle. The deflection roller 18 is pivoted into the desired position manually. The bobbin build up of the cross-wound bobbin 10, 11 can be improved with the reduction in the prestressing of the yarn 5.

A support element 23, 24 configured as a housing carries both the friction roller 14, 15 and the advance roller 8, 9. A pneumatic cylinder 25, 26 pivotably mounted at one end on the frame 4 of the textile machine engages with the other end on the support element 23, 24. The friction roller 14, 15 is fixed on a drive shaft 27, 28 extending in the longitudinal direction of the textile machine and is made to rotate thereby. The drive shaft 27, 28, apart from the axis of rotation of the friction roller 14, 15, also provides the pivot axle for the support element 23, 24. The rotary mounting of the drive unit on the drive shaft 27, 28 is implemented by means of a semi-open, two-part rotary device, which is stationarily connected to the frame 4. The support element 23 arranged on the left in the view of the FIGURE is in the operating position. In the operating position, the support element 23 is supported on the frame 4. The cross-wound bobbin 10 rests on the friction roller 14 and is kept in rotation thereby. The pneumatic cylinder 25 may be connected to a compressed air source 32 by means of the lines 29, 30 via a valve device 31 and thus acted upon by compressed air. The valve device 31 is controlled by the control device 34 by means of the control line 33.

The yarn 5 supplied by the spindle region of the workstation runs through the wind-on device 2 and is wound onto the cross-wound bobbin 10. The yarn 5 is guided here around the deflection device 18 in such a way that the looping angle on the advance roller 8 has been slightly increased. The advance roller 8 is driven by the drive shaft 27 by means of two round belt wheels 35, 36 and a round belt 37. The continuously circulating round belt 37 and the rotating round belt wheels 35, 36 are screened from the environment by the support element 23 configured as a housing and protected from soiling. The screening achieves good protection against accidents. The support element 23 has a shovel-shaped attachment 38, which is directed at the cross-wound bobbin 10 but does not touch it in the operating position.

If the stop motion 6 detects that there is no longer any yarn 5 present, a signal to the control device 34 is generated via the line 39. With the aid of the valve device 31, the pneumatic cylinder 25 is acted upon by compressed air and a pivoting up of the support element 23 is brought about. This leads, as described below, automatically and inevitably to the pivoting up of the cross-wound bobbin 10 held by the creel 12 about the pivot axle 46.

The support element 24 arranged on the right in the view of the FIGURE has already been pivoted up and is located in the service position. The stop motion 7 has established that there is no longer any yarn present and thereupon generates a signal to the control device 34 via the line 40. The control device 34 has actuated the valve device 31 via the control line 33. The pneumatic cylinder 26 is connected to the compressed air source 32 via lines not shown in the FIGURE. The drawing out of the pneumatic cylinder 26 has brought about the pivoting process of the support element 24 about the drive shaft 28 into the service position. The drive shaft 28 continues to drive the advance roller 9 via the round belt wheels 41, 42 by means of the round belt 43. The continuously circulating round belt 43 and the rotating round belt wheels 41, 42 are covered by the support element 24 configured as a housing. When the support element 24 is pivoted up, the attachment 44 rests on the cross-wound bobbin 11 and entrains it during its pivoting movement. In the process, the creel 13 pivots about the pivot axle 45. The cross-wound bobbin 11 has been raised from the friction roller 15 and is therefore now driveless. The shovel-shaped attachment 44 prevents yarn ends being able to be wound into the still rotating parts of the drive shaft 28 or the friction roller 15.

Owing to the pivoting up of the support element 24, the advance roller 9 in the service position is higher by the distance designated in the FIGURE by X than the advance roller 8 on the support element 23 in the operating position. This means that the free space for servicing is considerably greater for the spindle. Thus, a uniform design of textile machines configured as two-for-one twisters or as a ply twisters can be selected for feeds of different sizes. The ergonomic servicing height, characterised in the FIGURE by the reference designation EH, may be kept smaller than 1,300 mm and thus satisfies the requirements of ergonomics on textile machines of this type.

What is claimed is:

1. Wind-on device for workstations of a two-for-one twister machine or a ply twister machine comprising a take-up bobbin, a drive shaft extending in the longitudinal direction of the machine, a friction roller which is driven by the drive shaft and causes the take-up bobbin to make a rotational movement for winding of a traveling yarn thereon, a traversing yarn displacement device for delivering the yarn traversingly to the take-up bobbin to wind thereon in a cross-winding manner, and a driven advance roller positioned upstream of the friction roller relative to a path of yarn travel onto the take-up bobbin for looping of the traveling yarn about the advance roller for reducing tension in the yarn prior to winding on the take-up bobbin, characterised in that in addition to the friction roller (14, 15), the advance roller (8, 9) is also driven by the drive shaft (27, 28) and in that the advance roller (8, 9) is mounted on a support element (23, 24) and pivots together with the support element (23, 24) about a pivot axle selectively into an operating position or into a higher situated service position.

2. Wind-on device according to claim 1, characterised in that the friction roller (14, 15) is fixed on the drive shaft (27, 28) and the advance roller (8, 9) is driven by means of a transmission element (27, 43) by the drive roller (27, 28).

3. Wind-on device according to claim 2, characterised in that the transmission element (37, 43) is configured as a round belt.

4. Wind-on device according to claim 1, characterised in that the drive shaft (27, 28) forms the pivot axle of the support element (23, 24).

5. Wind-on device according to claim 1, characterised in that the support element (23, 24) comprises an attachment (38, 44) directed toward the take-up bobbin, which attachment lifts the take-up bobbin from the friction roller (14, 15) into the service position.

6. Wind-on device according to claim 1, characterised in that an activatable lifting cylinder engaging on the support element (23, 24) is present, by means of which the support element (23, 24) is pivoted.

7. Wind-on device according to claim 6, characterised in that the lifting cylinder is configured as a pneumatic cylinder (25, 26).

8. Wind-on device according to claim 1, characterised in that a stop motion (6, 7) is arranged in the path of yarn travel upstream of the advance roller (8, 9) and generates a signal to pivot up the support element (23, 24) if a yarn (5) is no longer detected.

* * * * *